United States Patent [19]

Schoonbeck

[11] 4,406,107

[45] Sep. 27, 1983

[54] METHOD AND APPARATUS TO REPAIR HOLES IN WALLS

[76] Inventor: Richard Schoonbeck, 9051 E. Kenyon Dr., Tucson, Ariz. 85710

[21] Appl. No.: 278,758

[22] Filed: Jun. 29, 1981

[51] Int. Cl.[3] ..... E04G 23/02

[52] U.S. Cl. ..... 52/514

[58] Field of Search ..... 52/514

[56] References Cited

U.S. PATENT DOCUMENTS

| | | | |
|---|---|---|---|
| 2,162,658 | 6/1939 | Wieslander | 52/514 X |
| 2,598,194 | 5/1952 | Shippey | 52/514 |
| 2,692,425 | 10/1954 | Martin . | |
| 3,470,048 | 9/1969 | Jones . | |
| 3,920,497 | 11/1975 | Speer . | |
| 3,999,347 | 12/1976 | Devlin . | |
| 4,075,809 | 2/1978 | Sirkin . | |
| 4,122,222 | 10/1978 | Parker . | |
| 4,193,243 | 3/1980 | Tiner . | |
| 4,285,183 | 8/1981 | Condit | 52/514 |

*Primary Examiner*—Kenneth Downey

*Attorney, Agent, or Firm*—J. Michael McClanahan

[57] ABSTRACT

Method and apparatus to repair holes in walls comprising a perforated flexible plate adapted to be inserted through the opening in the wallboard of the wall, the flexible plate having a peripheral edge coated with adhesive to engage and attach against the inside surface of the wallboard around the opening therethrough. Located generally central to the flexible plate is a transverse threaded screw, the threaded screw adapted to hold in the opening in special alignment between the opposite sides of the wallboard, perforated resilient plate or metal lath plate attached to the transverse threaded screw by means of a nut affixed to the plate or by means of opposing nuts with the plate therebetween. The perforated resilient or metal lath plate utilized is sized to be slightly smaller than the opening in the wall. The perforated flexible plate is sized to be slightly larger than the opening in the wallboard. The opening in the wall, now having metal lath located centrally thereto, is filled with repairing material, nominally plaster or grout, to a point where it bulges slightly over the flat surface of the surrounding wall. The repairing material is allowed to dry, and upon complete drying, is sanded away until a flat continuous surface is achieved between the wall and the patch. The surface is then painted with a matching colored paint.

11 Claims, 3 Drawing Figures

METHOD AND APPARATUS TO REPAIR HOLES IN WALLS

BACKGROUND OF THE INVENTION

It has been determined that with the increasing use of relatively weak walls used on the interiors of houses and commercial buildings, nominally the use of gypsum material wallboard having a thickness of ½ inch to 1 inch, it is increasingly common for holes to be knocked or punched through the wallboard between the wall studs. These holes can be caused by a door handle swinging around to engage and punch through the wallboard, to a person driving their fist through the wallboard. In any event, holes are created in the wallboard and for any of numerous reasons, obviously must be repaired. Presently these repairs are accomplished by what is perhaps the most common method, that of sticking wadded-up newspaper into the void between the two sides of the wall there, through the normal resistance in being wadded, the newspaper provides a backing against which plaster may reside. After the newspaper has been wadded-up and placed into the volume between the two pieces of wallboard, the plaster is then placed into the hole, the operator hoping that the plaster itself will provide strength to the patch job. The plaster is allowed to dry and then the outside of the path prepared by sanding and painting.

Now it has been known, through the use of this method, that the plaster, over a period of time, continues to dehydrate and thereby to shrink slightly. This shrinkage, though slight, will crack at its border and cause an outline of the opening which was repaired, to appear in the wall. In some minor cases, this outline may be covered over by additional painting, or by placing putty on the wall, sanding same, and then painting again. In any event, this causes a great deal of problem and does not provide a good patch repair job. In addition, it is very common for the plaster to develop cracks within itself, or to chip and thus causing more repair work.

Now there have been devices invented which do provide a backing material, cemented to the interior surface of the wallboard, to receive and substantially provide a stop for the plaster filling the opening in the wallboard. For example, Tinner, in U.S. Pat. No. 4,193,243, illustrates such a device where a rectangular plate is placed within the wall void, and cemented to the interior of the wall surface. The volume within the opening in the wallboard between the outside surface and the perforated plate shown in Tinner is then filled with plaster or other repair material. Thereafter, the surface of the patch is prepared. Shortcomings of Tinner are obvious, firstly that the original opening in the wallboard must be increased in size from the original opening in order to take the plate which has been prepared for use in the repair.

Secondly, the most important, Tinner does not take into account the long term drying shrinkage that plaster materials go through as they dehydrate over a period of time. As a consequence, the patch repair anticipated by Tinner will develop a rectangular shaped outline of the opening which was repaired as the plaster material withdraws from the sides of the opening. This, as earlier mentioned, will then develop as a crack in the paint which will make the outline of the opening quite visible, requiring additional repair. Cracking and or chipping of the repair plaster are additional problems which develop over time.

Other devices and repair kits have been developed by different inventors, however, all the prior art that the Applicant is aware of does not take into account the shrinkage of the repair material over extended periods of time, and the resultant consequences thereof.

As a consequence, it is apparent there is a need for a wall repair method and apparatus which does not require the operator to additionally repair the job as the patch material continues to dry and shrink.

SUMMARY OF THE INVENTION

The present invention comprises a method and apparatus to repair openings in walls, nominally the type of opening which has been formed in gypsum type wallboard utilized for interior walls of residences and commercial applications.

To that end, the subject invention comprises a perforated flexible plate which is cut to size to conform generally to the opening through the wallboard, allowing a border on the flexible plate to receive and hold an adhesive in place for attaching to the interior surface of the wallboard. The flexible plate has centrally located a transverse threaded screw, which threaded screw is used to push the flexible material through the opening in the wall and then, upon pull back, to hold the flexible material in place in order that it completely encompass the opening and the peripherially located adhesive cement to the interior surface of the wallboard surrounding the opening. Next, two inhibit shrinkage of the plaster or grout repair material, a perforated plate, such as expanded type metal lath, is secured upon the transverse threaded screw in spacial alignment between opposite flat surfaces of the wallboard and within the opening itself. The plate may be either expanded metal lath commonly available in the construction industry, used to cover walls prior to plastering, or a resilient perforated plate made out of metal or plastic or the like. The metal lath, or resilient metal plate, is sized by means of metal shears to conform generally to the shape of the opening and to approach the interior walls of the opening as near as reasonably possible, however, realizing that no part of the lath should engage or extend outwardly of the side of the wallboard. In operation, the elongated screw may be pulled slightly outward by deforming the interior flexible plate, the lath screwed up to a position where it would be located between the flat surfaces of the wallboard, and then when the lath has been properly located, the threaded screw released at which time the flexible plate will pull the lath into the opening in the wallboard. At that point, the securing nuts securing the lath to the threaded screw are secured and the threaded screw sheared at a point below the outside surface of the wallboard.

Continuing, the opening is completely filled with the plaster or grout repair material allowing it to hump slightly on the outside, and then permitted to dry. Upon drying, the outside is sanded to present a flat continuous surface and then the wall prepared with paint or other material.

It is an object of the subject invention to present a method and apparatus to repair openings in walls where the plaster material, upon continued dehydrate and shrinkage, does not pull away from the sides of the opening in the wallboard.

It is a further object of the subject invention to provide a quick and easy method and apparatus to repair a wall where internal strength is added to the plaster or grout repair material to retard chipping and cracking of the repair material.

These objects, and other objects will become readily apparent to the reader as he proceeds through the specification detailing the device.

DETAILED DESCRIPTION OF THE PREFERRED EMBODIMENT

Figure 1:
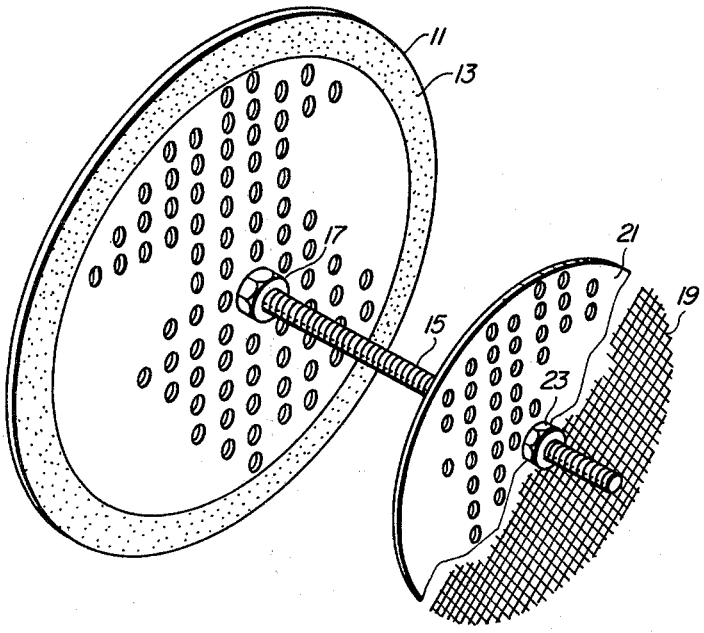
FIG. 1 is a perspective view of the subject inventive device.

Referring now to FIG. 1, a perspective view of the subject invention is shown in detail. The device is shown as one would purchase it in a kit for use in repairing a hole in a wall, most commonly repairing one side of a wall where the wall consists of two spaced apart gypsum wallboard as commonly used in residential and commercial building interior walls.

In FIG. 1, initially shown is flexible perforated plate 11, this flexible plate having, in the preferred embodiment, a shape which conforms to and is slightly larger (in the order of 1 inch) than the hole in the wall. Now this shape can be circular as shown in FIG. 1, or it can be any other shape, i.e., square, rectangular, or irregular. In fact, the shape of this flexible plate can be tailored to the hole in the wall from a larger flexible plate by cutting the flexible material to fit with a pair of shears. Around and near the edge of flexible plate 11, but on the flat surface portion, is applied an adhesive 13 which will attach to the inside surface of the wallboard which has the hole that is being repaired. This adhesive, when dry, holds flexible plate 11 in place, serving both to provide means to hold the remaining portion of the invention and to provide a back stop for repair material.

Located centrally to flexible plate 11 is transverse elongated plastic, nylon, or metal threaded screw 15 which is held to flexible plate 11 by means of nut 17. Nut 23 attached at the opposite end of threaded screw 15 is the means by which the repairing plaster, grout, or the like is held in place to retard shrinkage. This portion comprises either a perforated resilient plate 21 or expanded metal lath plate 19. For purposes of illustration, one/half of the plate was shown as a perforated resilient plate 21 and one/half as the lath plate 19. The plate utilized, of whichever type, is held by means of nut 23 which can either be attached to the particular perforated resilient or expanded metal lath plate material or, as shown later, can be one of two nuts screwed together with the plate material therebetween. In the configuration shown in FIG. 1, the device is now ready to be attached to a wall for usage by the operator.

Figure 2:
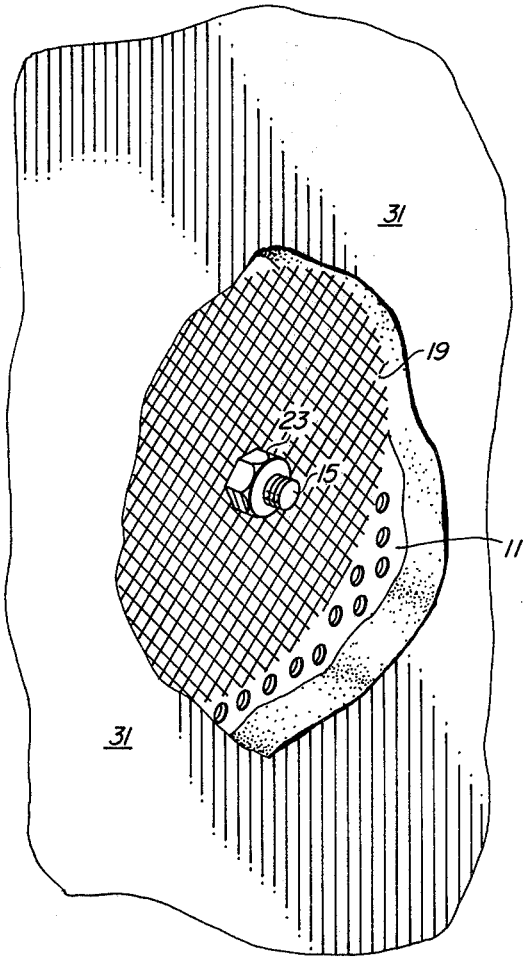
FIG. 2 is a perspective view of the invention in place repairing an opening in a wallboard.

Referring now to FIG. 2, a perspective view of the subject invention in place in the opening formed in wall 31 is detailed. For simplicity of illustration, the expanded metal lath plate 19 has been utilized. Firstly, wallboard 31 is shown in perspective with the lath plate 19 completely encompassed within this opening. Flexible plate 11 is shown internally to the opening in wallboard 31, but is not a part of the lath plate 19. Holding lath plate 19 in place are screw 15 and top nut 23. As is readily seen in FIG. 2, the lath plate 19 conforms generally to the outline of the opening in wallboard 31. This is accomplished, in most cases, by cutting the lath plate 19 with a pair of metal shears. Also note that enlogated screw 15 has been cut off near nut 23.

Figure 3:
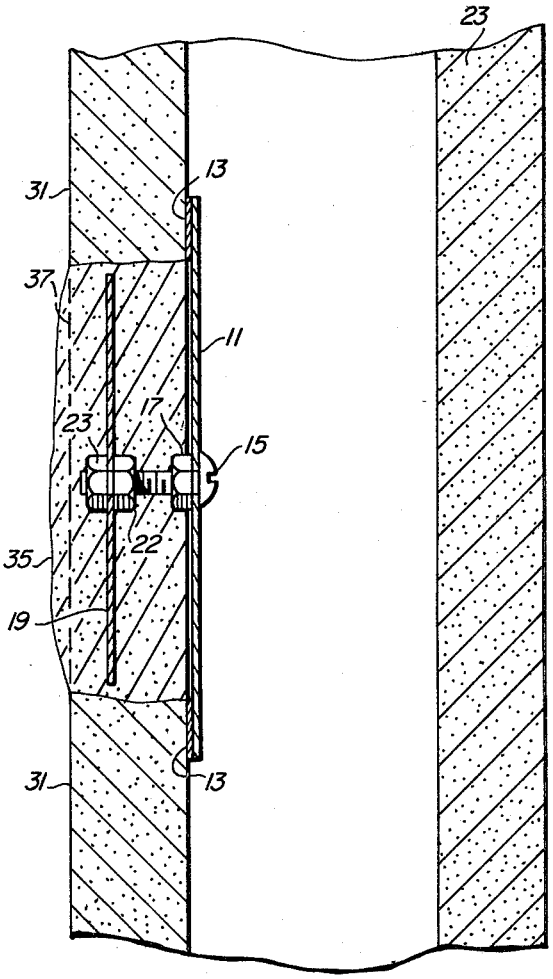
FIG. 3 is a side sectional view of the device in in place in a wallboard repairing an opening in the wallboard.

Referring now to FIG. 3, a cross-sectional view of the subject invention in place in a wall is detailed. Firstly, as earlier stated, the wall generally comprises two spaced apart wallboards, here wallboards 31 and 33, with a void therebetween. Then in the opening located in wallboard 31 is situated the subject invention. Starting from right to left, flexible plate 11 is in the interior portion of the wall between the spaced apart wallboards 31 and 33, flexible plate 11 being attached to the inside surface of wallboard 31 by means of adhesive 13 (the thickness of which has been exaggerated). Located centrally in flexible plate 11 is the head of transverse threaded screw 15, threaded screw 15 held in place by securing nut 17. Continuing out on the threaded screw 15 is seen, in spaced alignment, expanded metal lath plate 19 located centrally in the thickness of wallboard 31. Lath plate 19 is held in place, in the preferred embodiment, by means of screwed together nuts 22 and 23. Please note that threaded screw 15 is no longer as elongated as shown in FIG. 1, but in fact has been cut off by means of a bolt cutter, pliers, or other similar tool to the point where its end is recessed inward from the outside surface of wallboard 31.

Completely filling into the opening in wallboard 31, around all parts of the lath plate 19, and abutting the flat surface of flexible plate 11 is the plaster or grout 35 which emerges slightly outward beyond the flat surface of wallboard 31. After the plaster or grout has dried, it is prepared by sanding across the sides of wallboard 31 to achieve a flat continuous surface. Dotted line 37 shows the resultant finished surface of plaster or grout 35 preparatory for painting or other final finish.

In operation, the inventive device is applied as follows: Firstly, a flexible plate 11 must be secured which will totally cover the opening in the wallboard 31 which is desired to be patched. Ideally, a rather large sheet of flexible plate 11 is secured and then a rough outline of the opening in the wall is drawn on the flexible plate 11 with the threaded screw assembly centrally located to the outline drawn on the flexible plate. Next, allowing a border of an inch or two around the outline drawn on flexible plate 11, the flexible plate is cut with a pair of, in most cases, metal cutting shears. Flexible plate 11 can be a thin sheet of flexible plastic or other materials sufficiently flexible. Next, to the inside peripheral surface of flexible plate 11 is added the adhesive 13.

Continuing, utilizing the transverse threaded screw or other instrument such as a screwdriver, flexible plate 11 is pushed through the opening in the wall, the plate flexing into a slightly conical shape as it is being urged through the wall. Once the plate completely passes into the wall and is aligned to encompass the opening in the wall, the plate is then pulled in the outward direction by means of pulling the elongated threaded screw 15. Through this method, the adhesive attached to flexible plate 11 engages the interior portion of wall 31. The plate is then held in place until the adhesive dries. This may be done manually or, if desired, the lath plate 19 could be screwed up through means of nut 23 to the outside surface of wallboard 31, remembering at this point that lath 19 has not been cut to shape so it will completely encompass the outside of the opening in the wallboard 31. The tension then is adjusted on the threaded screw 15 so that the flexible plate 11 is just slightly deformed inward to put a slight amount of pressure upon the adhesive engaging the inside wall surface of wallboard 31. The adhesive then is permitted to dry.

After the adhesive 13 has dried sufficiently well, nut 23 is then screwed off of threaded screw 15 to allow removal of the lath plate 19, if that method above was used. Screw 22, if it has not always resided near nut 17, may now be rotated inward so that it resides substantially central to the thickness of the hole in wallboard 31. The metal lath 19, or for that matter if perforated resilient plate 21 is utilized, is cut to shape conforming generally to the insides of the opening in the wallboard 31. It is suggested that the lath plate 19 not touch the inside wall of the opening in the wallboard 31; however, it has been found in practice that, it is not all that important that the metal plate 19 not engage the interior wall of the wallboard 31. After the metal lath is cut to shape, it is placed on the threaded screw through one of the openings in the metal lath, or a centrally located perforation in the perforated resilient plate 21. The lath then is pushed up to nut 22, and then nut 23 is turned down on threaded screw 15 until it engages the lath 19 and secures the lath against nut 22. At that point, the threaded screw is then cut at a point where the stem remaining is recessed below the outside surface of the wallboard 31.

Now plaster or grout or other mixing material, such as plaster of paris, is placed into the opening to fill all parts of the opening, right up to the side of perforated flexible plate 11. The perforations allow air and excessive plaster or grout to exit (as well as any excessive adhesive at the periphery of plate 11). In the perferred embodiment, the grout is slightly humped on the outside of wallboard 31 in order that the operator be assured that with the shrinkage in the plaster upon drying, the outside surface will not shrink below the surrounding wallboard 31 surface. When the plaster or grout has completely dried, the operator then sands the plaster or grout to a smooth continuous finish, such as shown by dotted line 37, with the surrounding surface of wallboard 31. The plaster or grout now may be painted with a paint having a color matching the remainder of the wall.

As can be seen, with the metal lath in place, the natural tendency of the repair material to shrink prevents the material from shrinking away from the outline of the opening, and because of the strengthening qualities of the lath, the plaster will not crack, nor chip.

While a preferred embodiment of the invention has been shown and described, it would be understood that there is no intent to limit the invention by such disclosure, but rather it is intended to cover all modifications and alternate constructions falling within the spirit and the scope of the invention as defined in the appended claims.

I claim:

1. Apparatus to repair holes in walls comprising a flexible perforated plate adapted to be inserted through the hole in the wall and to attach to the inside surface of the wall proximate the hole; a threaded screw attached transversely to the flexible perforated plate; and a perforated resilient plate attached to said transverse threaded screw by means of at least one nut threaded on said screw and operably connected to said perforated resilient plate, said perforated resilient plate situated spacially in the hole of the wall whereby the hole in the wall is filled with plaster to the thickness of the wall with the plaster completely surrounding and penetrating the perforated resilient plate which serves to retard shrinkage of the plaster from the hole in the wall and to enhance resistance to chipping of the plaster.

2. The apparatus to repair holes in walls as defined in claim 1 wherein the flexible perforated plate is sized larger than the hole in order to encompass the hole, and that the flexible perforated plate is attached to the wall by means of an adhesive attached to the flexible perforated plate peripheral border.

3. The apparatus to repair holes in walls as defined in claim 2 wherein the transverse threaded screw penetrates an opening centrally located in said flexible perforated plate, and held to said flexible perforated plate by means of a nut screwed against the perforated flexible plate.

4. The apparatus to repair holes in walls as defined in claim 3 wherein said perforated resilient plate comprises expanded metal lath and said flexible perforated plate comprises plastic.

5. The apparatus to repair holes in walls as defined in claim 4 wherein said perforated resilient plate defines a resilient plate sized smaller than the hole in the wall sought to be repaired.

6. The apparatus to repair holes in walls as defined in claim 3 wherein the perforated resilient plate is held upon the transverse threaded elongated screw by means of two threaded nuts engaging opposite sides of the perforated resilient plate.

7. The method of repairing holes in walls comprising the steps of:

attaching a flexible perforated plate to one side of the wall;

locating in an opening centrally through the flexible perforated plate a transverse threaded screw;

securing the transverse threaded screw to the flexible perforated plate by a nut threaded upon the screw forcible against the flexible perforated plate;

placing a perforated resilient plate on the elongated threaded screw spaced away from the flexible perforated plate within the hole in the wall and between the sides of the wall; and placing plaster within the hole in the wall to encompass the perforated resilient plate within the hole and to the thickness of the wall whereby the plaster fills and repairs the hole in the wall and the perforated resilient plate prevents the plaster from shrinking from the hole in the wall and from chipping.

8. The method for repairing holes in walls as defined in claim 7 wherein the step of attaching the flexible perforated plate to one side of the wall includes the steps of placing adhesive on the periphery of the flexible plate, and bringing together the adhesive on the flexible perforated plate to the wall surrounding the hole.

9. The method for repairing holes in walls as defined in claim 8 wherein the step of placing the perforated resilient plate upon the threaded screw comprises the step of threading the nut attached to the perforated resilient plate upon the transverse threaded screw.

10. The method of repairing holes in walls as defined in claim 9 wherein the step of placing the perforated resilient plate upon the screw includes the step of sizing the perforated resilient plate to fit wholly within the opening in the wall and between the sides of the wall.

11. The method of repairing holes in walls as defined in claim 10 includes the step of cutting off the threaded screw at a point where it is completely encompassed by the plaster and does not extend beyond the surface of the wall.

* * * * *